US006739770B2

(12) United States Patent
Piccinino, Jr. et al.

(10) Patent No.: US 6,739,770 B2
(45) Date of Patent: May 25, 2004

(54) PHOTOGRAPHIC PROCESSOR HAVING AN EXPOSURE SECTION WITH AN INCLINED MEDIA PATH

(75) Inventors: Ralph L. Piccinino, Jr., Rush, NY (US); Andrew Zhou, XuHui (CN); Michael J. May, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/247,951

(22) Filed: Sep. 20, 2002

(65) Prior Publication Data

US 2004/0057722 A1 Mar. 25, 2004

(51) Int. Cl.[7] ..... G03D 3/08

(52) U.S. Cl. ..... 396/612; 396/620; 355/27; 134/64 P; 134/122 P

(58) Field of Search ..... 396/612–615, 396/617, 620, 626; 355/27–29, 72, 75; 134/64 P, 64 R, 122 P, 122 R

(56) References Cited

U.S. PATENT DOCUMENTS 3,782,820 A * 1/1974 Kohn et al. ..... 355/27
3,987,465 A * 10/1976 Sippel ..... 355/27
5,099,277 A 3/1992 Lucht et al.
5,436,688 A * 7/1995 Tanaka ..... 396/617
5,761,564 A 6/1998 Piccinino, Jr.
5,786,909 A 7/1998 Miyawaki et al.
5,933,214 A * 8/1999 Satoh et al. ..... 355/40
5,943,121 A 8/1999 Patton et al.
5,966,198 A * 10/1999 Yamamoto et al. ..... 355/27
6,126,337 A 10/2000 Gates et al.
6,130,998 A * 10/2000 Ochiai ..... 396/612
6,213,656 B1 4/2001 Piccinino, Jr. et al.
6,409,400 B1 * 6/2002 Arai ..... 396/612

* cited by examiner

*Primary Examiner*—D. Rutledge
(74) *Attorney, Agent, or Firm*—David A. Novais

(57) ABSTRACT

The present invention is directed to a photographic processor, such as a minilab, which includes at least an exposure section and a chemical development section. The exposure section of the minilab includes an inclined or slanted conveying path that receives photographic paper or media with the emulsion side in a first orientation, such as emulsion side-up; transports the photographic media emulsion side-up to an exposing position where the emulsion side of the photographic media is exposed to light, turns the exposed photographic media around so that the emulsion side is in a second orientation, such as emulsion side down; and conveys the photographic media emulsion side-down to an exit of the exposure station.

12 Claims, 1 Drawing Sheet

PHOTOGRAPHIC PROCESSOR HAVING AN EXPOSURE SECTION WITH AN INCLINED MEDIA PATH

FIELD OF THE INVENTION

The present invention relates to a photographic processor, such as a minilab, which includes an exposure section, a processing section and a finishing or drying section. In the exposure section, a conveying path for photographic media is positioned at an angle or incline and defines a turnaround section for the photographic media.

BACKGROUND OF THE INVENTION

In a typical minilab, there is provided an entrance for photosensitive or photographic media which leads to a processing path along which a photosensitive media is transported for printing and development. After being inserted in the minilab through the entrance, the media is typically conveyed along a horizontal route to an exposure section. Also, the media is exposed in the exposure section with either the emulsion side up or down and delivered in that same orientation to a processing or chemical development section. The space needed to accommodate a horizontal media path in the exposure section of the minilab tends to increase the overall size of the minilab. It is generally preferred that minilabs be of a smaller size since they are provided in limited space locations such as retail stores.

SUMMARY OF THE INVENTION

The present invention provides for a photographic processor in the form of a minilab which receives photographic media, such as photographic paper, for exposure in an exposure section of the minilab with the emulsion side in a first orientation, such as emulsion side up. The exposure section of the minilab of the present invention comprises a conveying path which is inclined or slanted and is adapted to turn the media around so as to deliver the exposed media with the emulsion side in a second orientation opposite to the first orientation, such as emulsion side down, to a development section of the minilab.

The present invention accordingly provides for a photographic processor which comprises an exposure section adapted to expose photographic media to record a latent image on the photographic media, with the exposure section comprising a slanted conveying path which receives photographic media emulsion side up, transports the photographic media emulsion side up to an exposing position where the emulsion side of the photographic media is exposed to light, turns the exposed photographic media around so that the emulsion side is down, and conveys the photographic media emulsion side down to an exit of the emulsion station. The photographic processor further comprises a chemical development section for developing images on the exposed photographic media. The chemical development section receives the exposed photographic media emulsion side down from the exit of the exposure section.

The present invention further provides for a photographic processor which comprises an exposure section that includes a slanted conveying path. The slanted conveying path has a first upper end located in a vicinity of a paper cassette exit and in a vicinity of an entrance to a chemical development section of the photographic processor. An upper side of the first upper end of the conveying path is positioned to receive photographic paper emulsion side up from the paper cassette and transport the photographic paper emulsion side up to an exposing position in the exposure section. The slanted conveying path has a second lower end which defines a turn-around section which turns the exposed photographic paper around to permit a transport of the photographic paper emulsion side down to a lower side of the first upper end of the conveying path. The photographic paper is transported emulsion side down from the lower side of the first upper end of the slanted conveying path to the entrance of the chemical development section.

The present invention further provides for a method of processing images which comprises the steps of delivering photographic paper emulsion side up to a slanted conveying path in an exposing section of a processor; conveying the photographic paper emulsion side up along the slanted conveying path to an exposing position; directing light onto the photographic paper to form a latent image on the photographic paper; conveying the exposed photographic paper to a turn-around section of the slanted conveying path to turn around the exposed photographic paper; conveying the exposed photographic paper emulsion side down to a chemical developing section; and developing latent images on the exposed photographic paper.

The present invention further provides for a photographic processor which comprises an exposure section adapted to exposure photographic media to record a latent image on the photographic media, with the exposure section comprising a slanted conveying path which receives photographic media with an emulsion side in a first orientation, transports the photographic media with the emulsion side in the first orientation to an exposing position where the emulsion side of the photographic media is exposed to light, turns the exposed photographic media around so that the emulsion side is in a second orientation opposite to the first orientation, and conveys the photographic media in the second orientation to an exit of the exposure station; and a chemical development section for developing images on the exposed photographic media, with the chemical development section receiving the exposed photographic media in the second orientation from the exit of the exposure section.

The present invention further relates to a method of processing images comprising the steps of delivering photographic media having an emulsion side in a first orientation to a slanted conveying path in an exposing section of a processor; conveying the photographic media with the emulsion side in the first orientation along the slanted conveying path to an exposing position; directing light onto the photographic media to form a latent image on the photographic media; conveying the exposed photographic media to a turn-around section of the slanted conveying path to turn around the exposed photographic media so that the emulsion side is in a second orientation opposite to the first orientation; conveying the exposed photographic media with the emulsion side in the second orientation to a chemical developing section; and developing the latent images on the exposed photographic media.

DETAILED DESCRIPTION OF THE INVENTION

Figure 1:
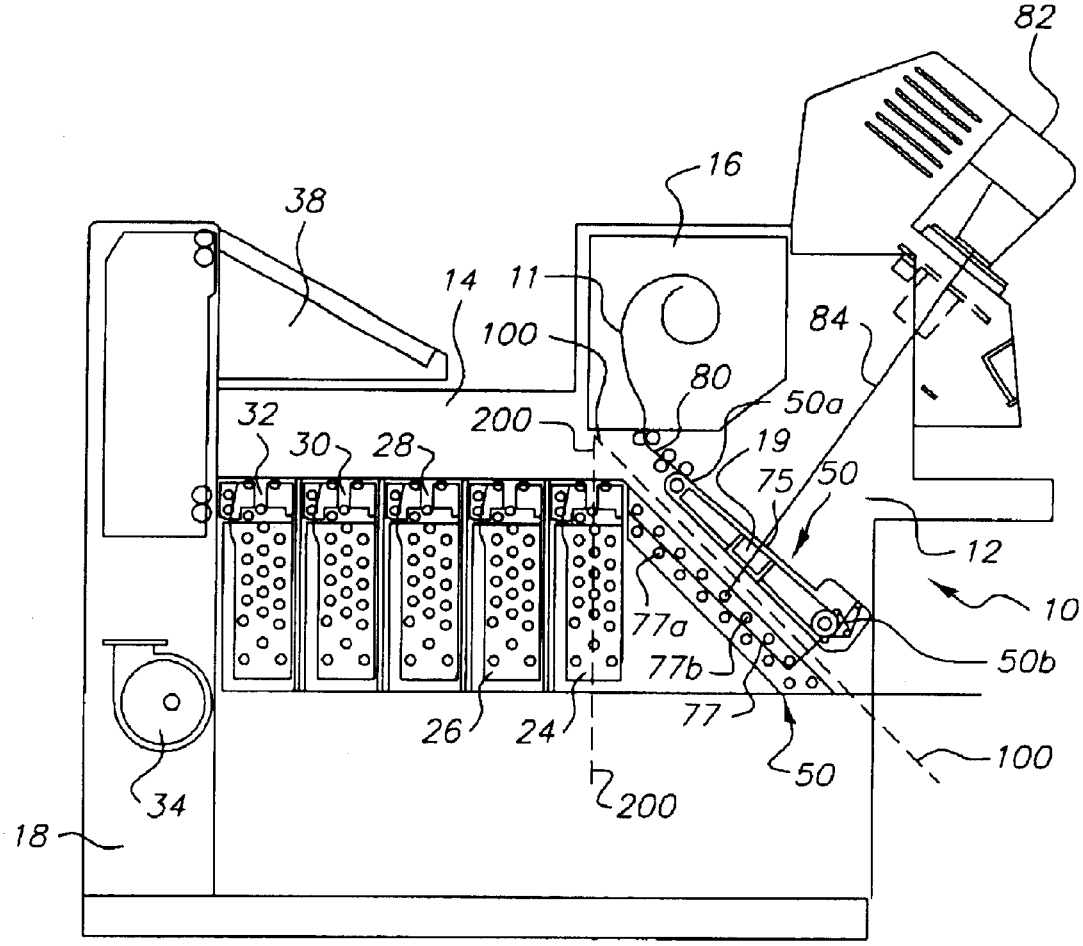
FIG. 1 is a front view of a photographic processor in accordance with the present invention.

The present description will be directed in particular to elements forming part of, or in cooperation more directly with, the apparatus in accordance with the present invention.

It is understood that elements not specifically shown or described may take various forms well known to those skilled in the art.

Referring to FIG. 1, there is illustrated a photofinishing apparatus 10 in accordance with the present invention. In the particular embodiment illustrated, photofinishing apparatus 10 defines what is typically referred to as a minilab, wherein images are first exposed onto a photosensitive or photographic media or paper 11 in an exposure section 12, and then passed through a processing or chemical development section 14 where the images exposed on media 11 are developed. Photosensitive media 11 travels along a processing path starting at supply section 16 in exposure section 12. After passing through chemical development section 14, photosensitive media 11 is then passed to a finishing station 18 where photosensitive media 11 can go through at least a drying operation and a sorting operation for sorting of individual prints.

As shown in FIG. 1, a supply of photosensitive media 11 is provided at supply section 16. In the particular embodiment illustrated, photosensitive media 11 comprises photographic paper provided in web form. In a preferred feature of the present invention, media 11 is cut after leaving supply section 16 and before reaching a slanted conveying path 50 by a known cutting arrangement (not shown). Therefore, photofinishing apparatus 10 is adapted to transport and process cut sheets. However, the present invention is not limited to processing cut sheets, and it is recognized that other types of media configurations such as continuous sheets can be processed in the processor of the present invention.

In a preferred feature of the invention, images are exposed on media 11 at an exposing or print platen or position 19. That is, in the embodiment illustrated, images on film, such as photographic negative film, are exposed onto media 11. Photosensitive media 11 travels along a processing path in exposure section 12 and in chemical development section 14. That is, after exposure of media 11, media 11 passes through chemical development section 14, wherein the exposed photosensitive media 11 is developed by passing it through a plurality of processing tanks containing appropriate processing solutions. In particular, photosensitive media 11 passes through a first development tank 24 wherein the latent images formed on photosensitive media 11 are developed. Development tank 24 contains an appropriate processing solution for developing of the images. After passing through development tank 24, photosensitive media 11 passes through tanks 26, 28, 30 and 32. In the particular embodiment illustrated, tank 26 is a bleach/fix tank containing a bleach/fix processing solution and tanks 28, 30, 32 each contain a washing solution for washing of the photosensitive media as it passes therethrough. It is, of course, to be understood that any desired number of processing tanks may be provided containing any appropriate processing solution required or desired for processing of photosensitive media passing therethrough.

After passing through processing tanks 24, 26, 28, 30 and 32, photosensitive media 11 passes through a dryer 34 and then to a sorter (not shown) where the individual prints are placed into an appropriate sorting bin 38, typically by customer order.

A preferred feature of the present invention relates to the provision of slanted or inclined conveying or conveyor path 50 within exposure section 12. Conveying path 50 could include but is not limited to rollers or a continuous belt and roller arrangement. With the use of slanted conveying path 50, it is possible to reduce the overall size and height, and more particularly the overall width and footprint of the photographic processor or minilab. Also, with the positioning of the slanted conveying path 50 as shown, paper cassette 16 delivers photographic paper to a first upper end 50*a* of conveying path 50 by way of a vertical path 80. First upper end 50*a* of slanted conveying path 50 is located in a vicinity of an exit of paper cassette 16 and a vicinity of an entrance to chemical development section 14. Thus, an upper side of first upper end 50*a* of conveying path 50 is positioned to receive photographic paper emulsion side-up from paper cassette 16 and transport the photographic paper emulsion side-up along upper path 75 to exposing platen or position 19 in exposure section 12. Slanted conveying path 50 includes a second lower end 50*b* which defines a turn-around section that turns the exposed photographic paper around to permit a transport of the photographic paper emulsion side-down along lower path 77 (which is defined between rollers 77*a* and 77*h*) to a lower side of first upper end 50*a* of conveying path 50. The photographic paper or media is therefore transported emulsion side-down from the lower side of first upper end 50*a* of slanted conveying path 50 to an entrance of chemical development section 14.

Due to slanted conveying path 50, it is possible to locate a light source 82 to provide a light beam 84 from above conveying path 50 onto exposing platen 19. More specifically, light beam 84 is oriented in a direction which is substantially perpendicular to an upper surface of conveying path 50, and inclined or slanted with respect to a vertical plane or direction. Thus as shown in FIG. 1, by having slanted conveying path 50 with respect to a vertical direction, as well as slanted light beam 84 also with respect to a vertical direction, it is possible to deliver media 11 emulsion side-up to exposing position 19 and to provide light beam 84 from above media 11. It is also possible to reduce the overall size and footprint of the photographic processor. Further, it is possible to provide for a turn-around section at 50*b* within exposure section 12, so as to permit the photographic paper to be (1) received emulsion side up on conveying path 50; (2) exposed at exposing position 19 and thereafter; (3) turned emulsion side-down for delivery to chemical development section 14.

With the arrangement of the present invention, it is possible to permit the emulsion side of the media to be up for exposure, and then permit the media to be turned around so that the emulsion side is down for processing. This provides an advantage in that the emulsion side of the media is up at exposure to permit the location of a light source at a position above the media, and permits the delivery of media emulsion side down to the chemical development section which facilitates processing. That is, by having the media emulsion side down in the chemical development section, it is possible to deliver solution to the appropriate processing tank from outside or below the tank since the emulsion side of the media will be either facing down or sideways as it travels through the processing tank. This helps reduce the overall size of the tanks and processor. Also, by having slanted conveying path 50 in the orientation shown in FIG. 1, it is possible to have a reduced size processor while at the same time maintaining an adequate spacing between exposing position 19 and chemical development section 14 so as to minimize any adverse effects to exposure from the chemical development section.

As shown in FIG. 1, light source 82 directs light onto slanted conveying path 50 in a direction which is substantially perpendicular to an upper surface of conveying path 50. Therefore, both light beam 84 from light source 82 as well as conveying path 50 are inclined or slanted as previously described and shown. As also shown in FIG. 1, slanted conveying path 50 is provided in a slanted plane (schematically represented by line 100) which forms an acute angle with a vertical plane (schematically represented by line 200) of first processing tank 24 of chemical development section 14. Additionally, with the structure shown in FIG. 1, plane or line 100 with includes inclined or slanted conveying path 50 forms an obtuse angle with a plane which includes vertical path 80 from paper cassette 16. This combination of features and angular relationships provides for the reduced size minilab or photographic processor of the present invention, while at the same time permits media to be exposed emulsion side up and then turned around for delivery to chemical development section emulsion side down.

Although a preferred feature of the present invention has been described with respect to the photographic media being delivered to conveying path 50 emulsion side up, being exposed emulsion side up, and being turned around and delivered to chemical development section 14 emulsion side down, the present invention is not limited thereto. It is recognized that slanted conveying path 50 can be utilized in an arrangement in which the photosensitive material is delivered to the exposure section emulsion side down. More specifically, in an arrangement where photographic media is delivered to the exposure section emulsion side down, light source 82 would be positioned to direct a light beam from a location below slanted conveying path 50. In this alternative embodiment, the photographic media would be delivered emulsion side down to conveying path 50 and conveyed, for example, along lower path 77 to an exposure position along lower path 77. After exposure, the photographic media would be turned around and delivered emulsion side up to a chemical delivery section. In this alternative embodiment, the media would not be delivered emulsion side down to the chemical development section, however, the advantage of having a slanted conveying path 50 which reverses the orientation of the media still reduces the overall size of the minilab.

Therefore, the use of slanted conveying path 50 permits photographic media to be received with the emulsion side in a first orientation (for example, emulsion side down) on conveying path 50, with the media being exposed while the emulsion side is in the first orientation. After exposure with the emulsion side in the first orientation, conveying path 50 is adapted to turn around the exposed photographic media so that the emulsion side is in a second orientation (for example, emulsion side down) that is opposite the first orientation, so as to deliver the photographic media to the chemical development section while in the second orientation. The ability to reverse the emulsion side of the photographic media while in the exposure section is possible due to use of slanted conveying path 50 of the present invention.

The invention has been described in detail with particular reference to certain preferred embodiments thereof, but it will be understood that variations and modifications can be effected within the spirit and scope of the invention.

What is claimed is:

1. A photographic processor comprising:

an exposure section adapted to expose photographic media to record a latent image on the photographic media, said exposure section comprising a first slanted conveying path which receives photographic paper emulsion side up, transports the photographic media emulsion side up to an exposing position where the emulsion side of the photographic media is exposed to light, turns the exposed photographic media around so that the emulsion side is down, and conveys the photographic media emulsion side down along a second slanted conveying path located below the first slanted conveying path, said second slanted conveying path leading to an exit of the exposure section; and a chemical development section for developing images on the exposed photographic media, said chemical development section receiving the exposed photographic media emulsion side down from the exit of said exposure section.

2. A photographic processor according to claim 1, further comprising a light source which directs light onto said first slanted conveying path to expose photographic media on said first slanted conveying path, said light source directing light in a direction which is substantially perpendicular to an upper surface of said first slanted conveying path.

3. A photographic processor according to claim 1, further comprising a photographic media cassette having a cassette exit which leads photographic media in a vertical direction onto the first slanted conveying path.

4. A photographic processor according to claim 1, wherein each of said first and second slanted conveying paths forms an acute angle with a first processing tank of said chemical development section.

5. A photographic processor comprising:

an exposure section comprising a first slanted conveying path, said first slanted conveying path having a first upper end located in a vicinity of a paper cassette exit and in a vicinity of an entrance to a chemical development section of the photographic processor, an upper side of said first upper end of said first slanted conveying path being positioned to receive photographic paper emulsion side up from the paper cassette and transport the photographic paper emulsion side up to an exposing position in said exposure section, said first slanted conveying path having a second lower end which defines a turn-around section which turns said exposed photographic paper around to permit a transport of the photographic paper emulsion side down to a second slanted conveying path located below said first slanted conveying path, said second slanted conveying path leading to lower side of said first upper end of the first slanted conveying path, said photographic paper being transported emulsion side down alone said second slanted conveying path to the entrance of said chemical development section.

6. A photographic processor according to claim 5, further comprising a light source which directs an exposing light beam onto an upper surface of said first slanted conveying path to expose photographic paper on said first slanted conveying path, said exposing light beam forming a substantially right angle with said first slanted conveying path.

7. A photographic processor according to claim 5, wherein a path from the exit of said paper cassette to the upper side of the first upper end of said first slanted conveying path is a substantially vertical path.

8. A photographic processor according to claim 5, wherein each of said first and second slanted conveying paths forms an acute angle with a first processing tank of said chemical development section.

9. A method of processing images comprising the steps of:

delivering photographic paper emulsion side up to an upper slanted conveying path in an exposing section of a processor;

conveying the photographic paper emulsion side up along the upper slanted conveying path to an exposing position;

directing light onto said photographic paper to form a latent image on the photographic paper;

conveying the exposed photographic paper to a turn-around section of said upper slanted conveying path to turn around the exposed photographic paper and place the exposed photographic paper on a lower slanted conveying path located below the upper slanted conveying path;

conveying the exposed photographic paper emulsion side down along said lower slanted conveying path to a chemical developing section; and developing the latent image on the exposed photographic paper.

10. A method according to claim 9, wherein each of said upper and lower slanted conveying paths forms an obtuse angle with a media path from a paper cassette to said upper slanted conveying path and an acute angle with a first processing tank of said chemical development section.

11. A photographic processor comprising:

an exposure section adapted to expose photographic media to record a latent image on the photographic media, said exposure section comprising a slanted conveying path having an upper slanted part which receives photographic media with an emulsion side in a first orientation, transports the photographic media with the emulsion side in said first orientation to an exposing position where the emulsion side of the photographic media is exposed to light, turns the exposed photographic media around so that exposed photographic media is on a lower slanted part of the slanted conveying path and the emulsion side is in a second orientation opposite to the first orientation, and conveys the photographic media alone said lower slanted part in said second orientation to an exit of the exposure station; and a chemical development section for developing images on the exposed photographic media, said chemical development section receiving the exposed photographic media in said second orientation from the exit of said exposure section.

12. A method of processing images comprising the steps of:

delivering photographic media having an emulsion side in a first orientation to an upper slanted part of a slanted conveying path in an exposing section of a processor;

conveying the photographic media with said emulsion side in said first orientation along the upper slanted part of the slanted conveying path to an exposing position;

directing light onto said photographic media to form a latent image on the photographic media;

conveying the exposed photographic media to a turn-around section of said slanted conveying path to turn around the exposed photographic media, and place said exposed photographic media on a slanted lower part of said slanted conveying path in a manner in which said emulsion side is in a second orientation opposite to said first orientation;

conveying the exposed photographic media along said slanted lower part of said slanted conveying path with said emulsion side in said second orientation to a chemical developing section; and developing the latent images on the exposed photographic media.

* * * * *

UNITED STATES PATENT AND TRADEMARK OFFICE

CERTIFICATE OF CORRECTION

PATENT NO. : 6,739,770 B2
DATED : May 25, 2004
INVENTOR(S) : Ralph L. Piccinino et al.

It is certified that error appears in the above-identified patent and that said Letters Patent is hereby corrected as shown below:

Column 6,
Line 44, after "down" delete "alone", insert -- along --

Column 7,
Line 34, after "media" delete "alone", insert -- along --

Signed and Sealed this

Twenty-third Day of November, 2004

JON W. DUDAS
*Director of the United States Patent and Trademark Office*